United States Patent [19]

Giebeler

[11] Patent Number: 4,729,267

[45] Date of Patent: Mar. 8, 1988

[54] CHAMPAGNE BOTTLE OPENER

[76] Inventor: Ben F. Giebeler, P.O. Box 30024, San Bernardino, Calif. 92413

[21] Appl. No.: 769,842

[22] Filed: Aug. 26, 1985

[51] Int. Cl.[4] ..... B67B 7/06

[52] U.S. Cl. ..... 81/3.37; 81/3.29

[58] Field of Search ..... 81/3.08, 3.36–3.37, 81/3.29, 3.4, 3.42, 3.44, 3.55–3.56, 3.39, 3.31–3.33, 125

[56] References Cited

U.S. PATENT DOCUMENTS

| | | | |
|---|---|---|---|
| 3,800,345 | 4/1974 | Feliz | 81/3.37 X |
| 3,835,737 | 9/1974 | Carr | 81/125 |
| 4,063,473 | 12/1977 | Bozzo | 81/3.37 |
| 4,253,351 | 3/1981 | Allen | 81/3.29 |
| 4,527,450 | 7/1985 | Drosky | 81/3.37 X |

FOREIGN PATENT DOCUMENTS

| | | | |
|---|---|---|---|
| 631295 | 12/1927 | France | 81/3.37 |

*Primary Examiner*—Debra Meislin

*Attorney, Agent, or Firm*—Lyon & Lyon

[57] ABSTRACT

A device for the controlled removal and re-insertion of the cork used with the conventional champagne bottle. The device has a first member having a cavity which is sized and shaped to straddle the neck of the bottle, and specifically the circumferential rib which the conventional champagne bottle has near the spout. A second member is sized and shaped to slide onto the head of the cork. Various types of handles, linkages and gears are shown to move the two members apart, linearly, and under leverage, so that the cork can be removed and re-inserted with ease.

12 Claims, 19 Drawing Figures

CHAMPAGNE BOTTLE OPENER

BACKGROUND

The device of this invention pertains to a mechanical apparatus for the controlled removal and re-insertion of the plastic cork (or any other similarly shaped cork) from and into the conventional champagne bottle. This type bottle has a circumferential rib around the neck of the bottle near the spout over which the wire stays on an unopened champagne bottle are tied.

The unopened champagne bottle can be, particularly if agitated, under great pressure. Many people, ceilings and light fixtures have been injured or damaged when struck by the champagne bottle cork, which can be propelled under great force when the bottle is opened. This problem is compounded when the cork is tightly stuck in the bottle such that great exertion is required to remove it. In this instance, the person opening the bottle is usually agitating the bottle, albeit unknowingly, in his or her attempts to open it. Also, because the person is intent upon winning out over the stubborn cork, the person may not be as careful as he or she should be in preventing the released cork from striking someone or something. Lastly, when the bottle is agitated, then opened, a significant portion of the champagne inside is lost.

These problems have existed heretofore because a simple, workable champagne bottle opener has not been available. Even today, the vast majority of all champagne bottles, particularly in the home, are opened by hand, with the user grasping the bottle around the neck, and pushing against the cork with his or her thumbs. Surprisingly, while many different devices are available for removing the cork from a wine bottle, the opening of a champagne bottle remains an unpleasant, potentially dangerous activity.

Therefore, a need exists for a simple, workable champagne bottle opener.

SUMMARY OF INVENTION

This invention provides such an opener in a device which has a first member which slides onto and straddles the neck portion of the champagne bottle, and specifically has a groove which engages the circumferential rib on the neck. A second member is slidable onto the head of the cork. Three different embodiments are provided as means to separate the first member from the second member linearly and under leverage so that the cork can be removed from and reinserted into the bottle easily and under control, without having to agitate the bottle. In the preferred embodiment, the device may be operated by one hand, as a single handle is journalled to both first and second members so that such rotation of the handle downward causes separation. Other embodiments using double handles are also provided.

It is therefore the object of this invention to provide a novel, useful champagne bottle opener.

DESCRIPTION OF THE FIGURES

FIG. 2 shows the handle and linkage mechanism.

DETAILED DESCRIPTION OF THE PREFERRED EMBODIMENT

As preferably embodied, all components are made of metal. It is foreseen, however, that many of the components could be made of polymer or composite materials.

Figure 1:
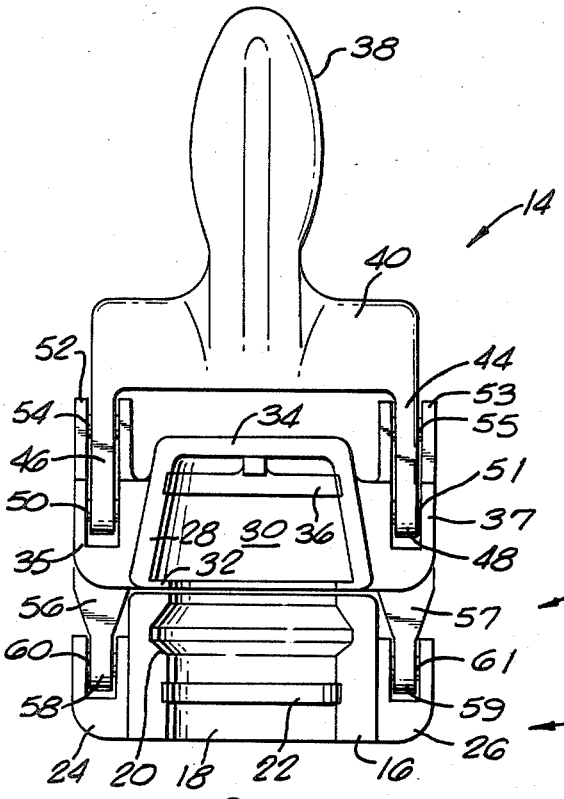
FIG. 1 is a front view of the preferred embodiment of this invention. In this position, the handle is up and the first and second members are together. In this position, the device would be fitted onto the neck of the bottle and the cork.

Looking at FIG. 1, the device comprises a first member, generally designated 10, a second member, generally designated 12, and handle and linkage means generally designated 14.

Figure 19:
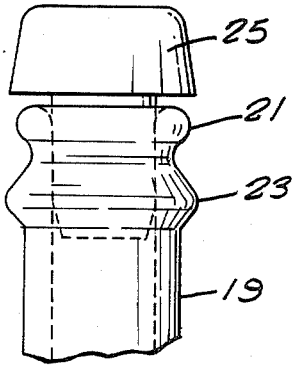
FIG. 19 is a side view of the neck and cork configuration of the standard champagne bottle.

First member 10 is preferably of unitary construction. The central body 16 of first member 10 is semi-cylindrical in shape, having a channel 18 formed therein. Cavity 18 approximates the outside configuration of the neck 19 and spout 21 (see FIG. 19) area of the standard champagne bottle. Specifically, a groove 20 is formed in cavity 18 to engage the circumferential rib 23 which rings the exterior of the standard champagne bottle, near the spout. Body 16 is horseshoe shaped such that it can slide onto the champange bottle from the side. A clip 22 resides in an appropriately sized groove in cavity 18 to grip the neck of the bottle so that first member 10 is held into position on the bottle, without the operator having to continuously hold the device in position by hand.

On opposing sides of body 16, clevises 24 and 26 are formed integrally with body 16. The importance of clevises 24 and 26 will be discussed later.

The second member 12 is also preferably of unitary construction. It has a body 28 in which cavity 30 is formed. The interior of cavity 30 has a flaired, helmet-like shape such that it will slide snugly, but comfortably, onto the head 25 of the standard plastic (or other similarly shaped) champagne cork. A semi-circular flange 32 rings the bottom of cavity 30 and extends inwardly such that when second member 12 is fitted onto the head 25 of the champagne cork, semi-circular flange 32 will extend under head 25. Flange 32, then, will be the surface which engages the head 25 of the cork to remove it. Conversely, the top piece 34 covers the top of cavity 30 and will be that surface which engages the head 25 of the cork during reinsertion. A clip 36 can be inserted into an appropriately sized groove in cavity 30 to hold the cork in cavity 30 after it has been removed from the bottle. Clevices 35 and 37 are formed on opposing sides of body 28.

In the preferred embodiment shown in FIGS. 1 through 5, the handle and linkage means 14 has an elongate handle 38 which is shaped for comfortable gripping by the person using the device. It should be noted that the handle is centrally located parallel to the center line of the overall device. The handle 38 is attached to a cross-piece 40. At either end of cross-piece 40, arms 42 and 44 (which are mirror images of one another) are formed. In the end of arms 42 and 44, a pair of lugs 46 and 48, respectively, are formed (see FIG. 2).

Figure 2:
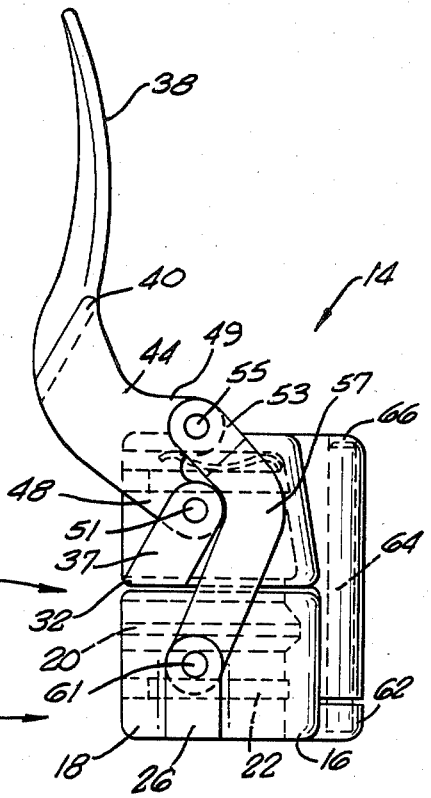
FIG. 2 is a side view of the device shown in FIG. 1.
Figure 3:
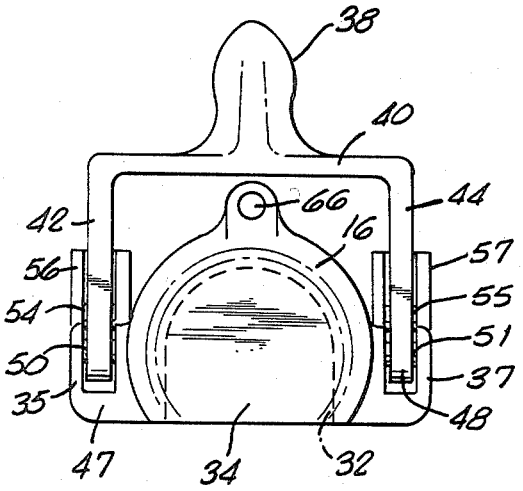
FIG. 3 is a top view showing the device in the open position.
Figure 4:
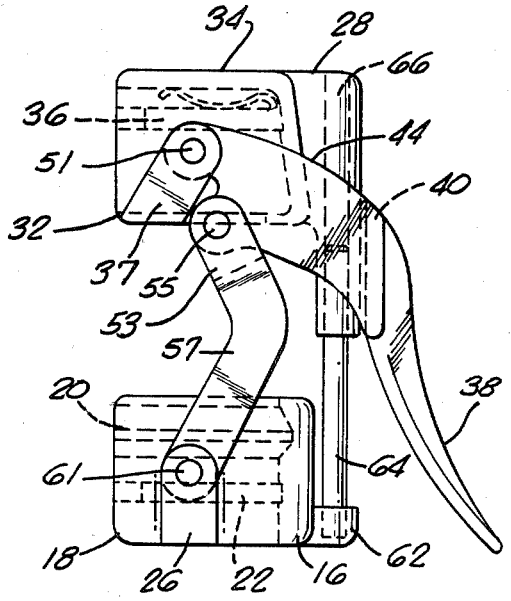
FIG. 4 is a side view showing the device in the open position. This illustrates how rotation of the handle downward causes the first and second members to separate.
Figure 5:
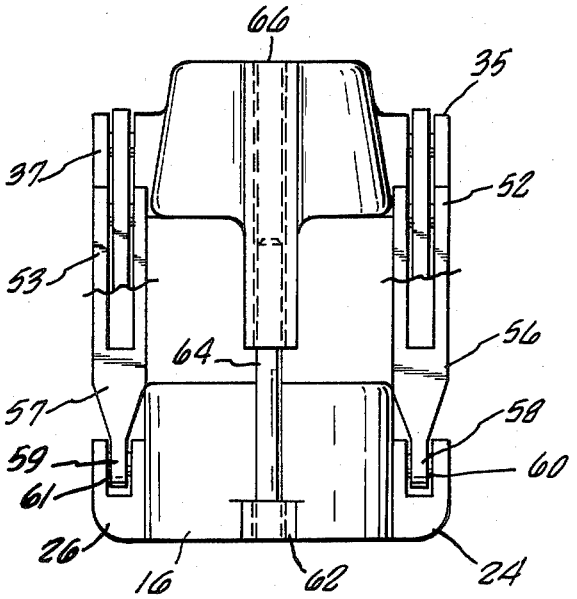
FIG. 5 is a back view of the device in the open position. In this figure, the handle has been broken away.
Figure 6:
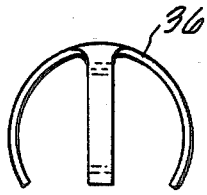
FIG. 6 is a top view of a clip which can be fitted into the second member to grip the cork.
Figure 7:
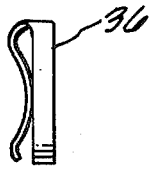
FIG. 7 is a side view of that clip.
Figure 8:
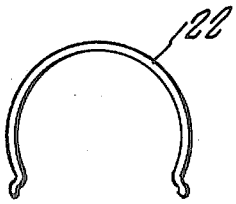
FIG. 8 is a top view of a clip that can be fitted into the first member to grip the bottle.
Figure 9:
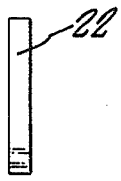
FIG. 9 is a side view of that clip.
Figure 10:
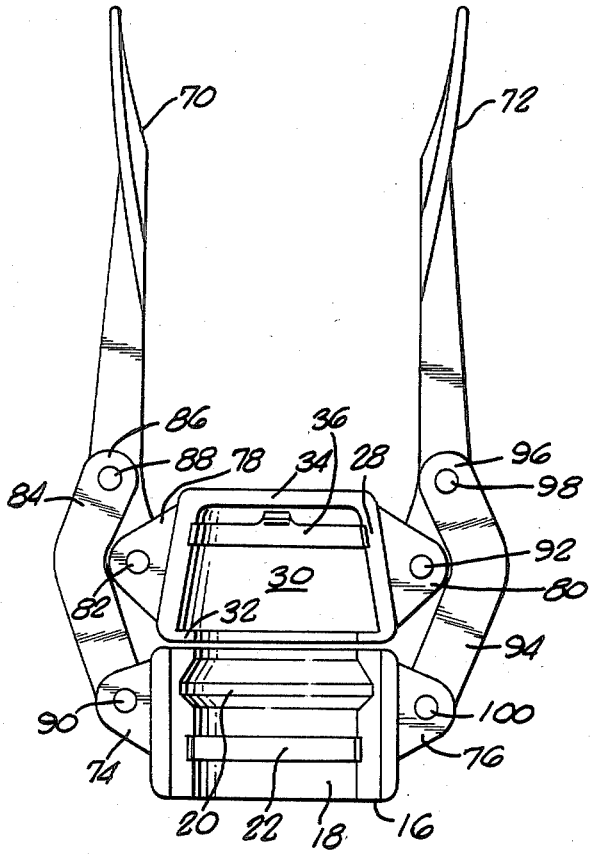
FIG. 10 is a front view of an alternate embodiment of this invention. Here, two handles and associated linkage are utilized to separate the first and second members.
Figure 11:
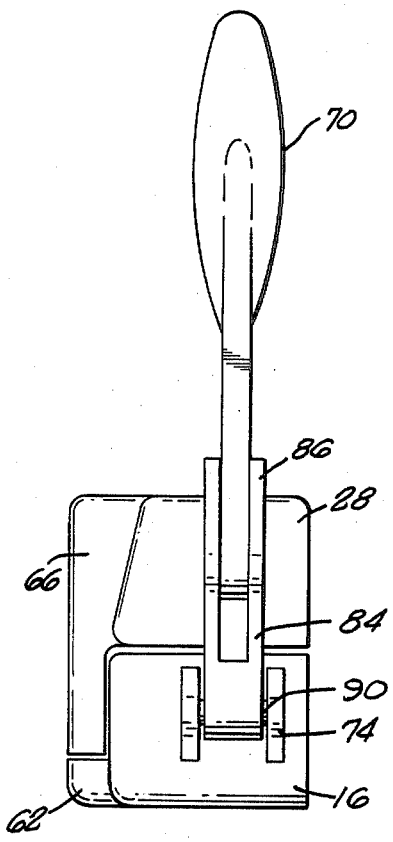
FIG. 11 is a side view of this alternate embodiment.
Figure 12:
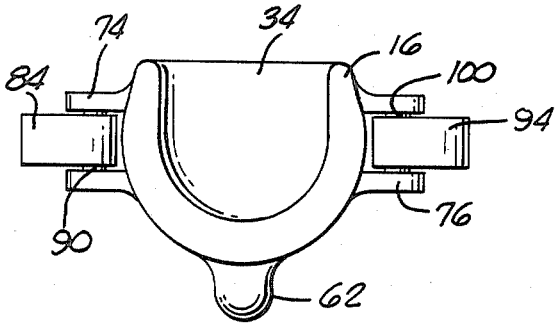
FIG. 12 is a bottom view of this embodiment.
Figure 13:
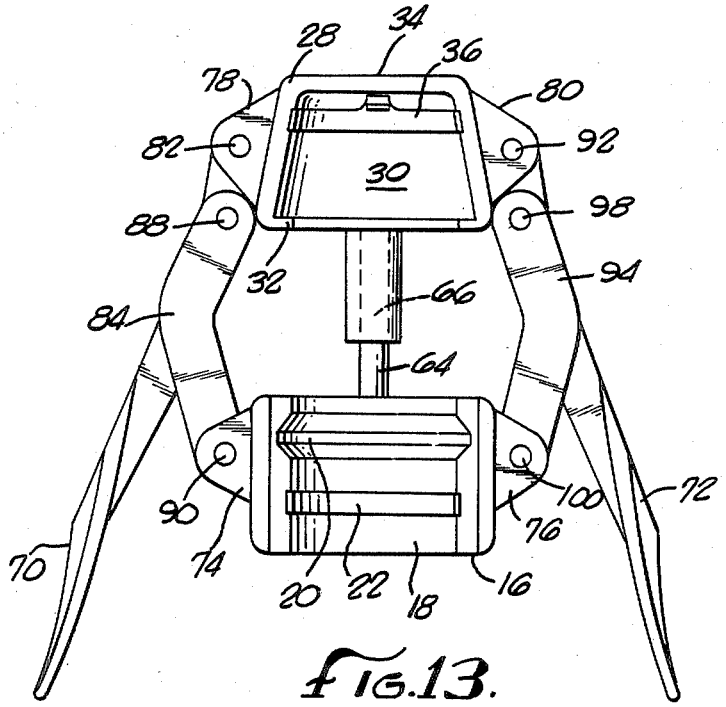
FIG. 13 is a side view of this embodiment, showing the device in the open, or separated position.
Figure 14:
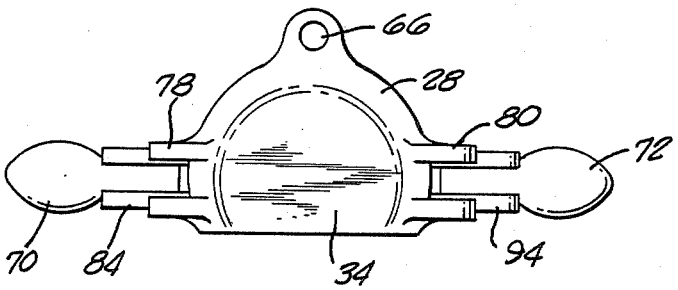
FIG. 14 is a top view of the device in the open position.

Lugs 46 and 48 are rotatably attached to clevises 35 and 37 by means of clevis pins 50 and 51. A second pair of lugs 47 and 49 are formed in arms 42 and 44 and are attached to clevises 52 and 53 by means of clevis pins 54 and 55. Clevis 52 is formed in one end of dog-leg linkage 56. Clevis 53 is formed in one end of dog-leg linkage 57. The other end of dog-leg linkages 56 and 57 have lugs 58 and 59 which are rotatably attached to clevises 24 and 26 by means of clevis pins 60 and 61. As seen in FIG. 2, the placement of these various components are such that when the device is in the closed position (with first member 10 and second member 12 being brought together), the center points for clevis pins 51, 55 and 61 (and their mirror-image counterparts) are aligned, when viewed from the side, with the approximate center line of the neck 19 and cork 25 of the bottle to be opened. This provides for the linear separation of second member 12 from first member 10 when handle 38 is rotated in a clockwise direction as viewed in FIG. 2. To further insure linear travel, guide means are provided. A pin holder 62 is formed integrally with the body 16 of first member 10. A pin 64 extends parallelly to the center line of the cavity 18 and the cavity 30. A guide channel 66 is formed to second member 12. Pin 64 is housed and slidable within guide channel 66.

In an alternate embodiment, shown in FIGS. 10 through 14, the single handle linkage means are modified to use two, opposing handles 70 and 72. Further, in this embodiment, although body 16 of first member 10, and body 28 and cavity 30 of second member 12 remain the same, clevises 74 and 76 replace the clevises 24 and 26 in the previous embodiment in first member 10. Similarly, clevis 78 and clevis 80 replace clevises 35 and 37 on second member 12.

Handle 70 is journalled to clevis 78 by means of clevis pin 82. Handle 70 is also journalled to linkage 84 by means of clevis 86 which is formed in the proximal end of linkage 84, and by clevis pin 88. The distal end of linkage 84 is journalled to clevis 74 by means of clevis pin 90. Similarly, on the other side, handle 72 is journalled to clevis 80 by means of clevis pin 92, and to linkage 94 by means of clevis 96, which is formed in the proximal end of linkage 94, and by clevis pin 98. In turn, the distal end of linkage 94 is journalled to clevis 76 by means of clevis pin 100. In this embodiment, the pin holder 62, pin 64 and guide channel 66 operate the same as in the previous embodiment.

The third embodiment of this invention is shown in FIGS. 15 through 18. Here, the body 102 of the first member 10, in addition to having channel 18 and groove 20, has side flanges 104 and 106, which, in connection with body 102 and cross-member 108, frame an open space 110 above body 102 and between flanges 104 and 106.

Flanges 104 and 106 each have a groove 112 and 114, respectively, extending therethrough in which handles 116 and 118 are journalled by means of journal pins 120 and 122. In the region near journal pins 120 and 122, grooves 112 and 114 open into and communicate with open space 110. This opening allows the ratchet teeth 124 and 126, formed in the end of handle 116 and handle 118, respectively, to protrude into open space 110. The ratchet teeth 124 and 126 are semi-circular in configuration, having journal pins 120 and 122 as the center point, respectively.

Figure 15:
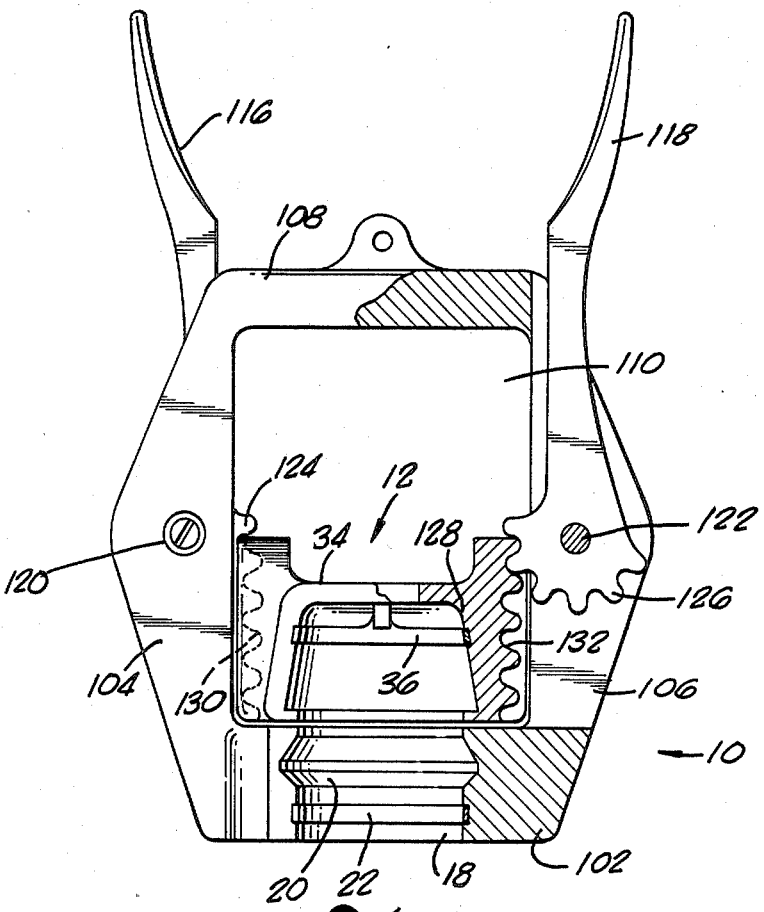
FIG. 15 is a side view, with a portion cut away, of a third embodiment of this invention. Here, two handles, each of which has a ratchet tooth configuration which engages a rack gear on the second member, are used to cause the first and second members to separate.
Figure 16:
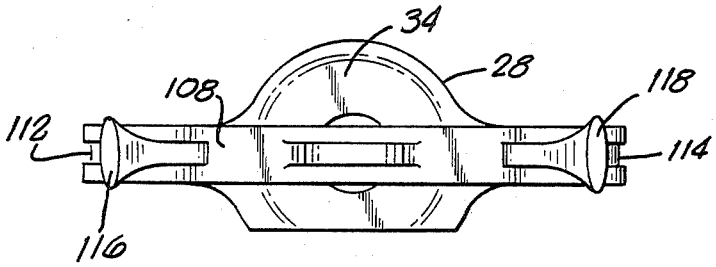
FIG. 16 is a bottom view of this third embodiment.
Figure 17:
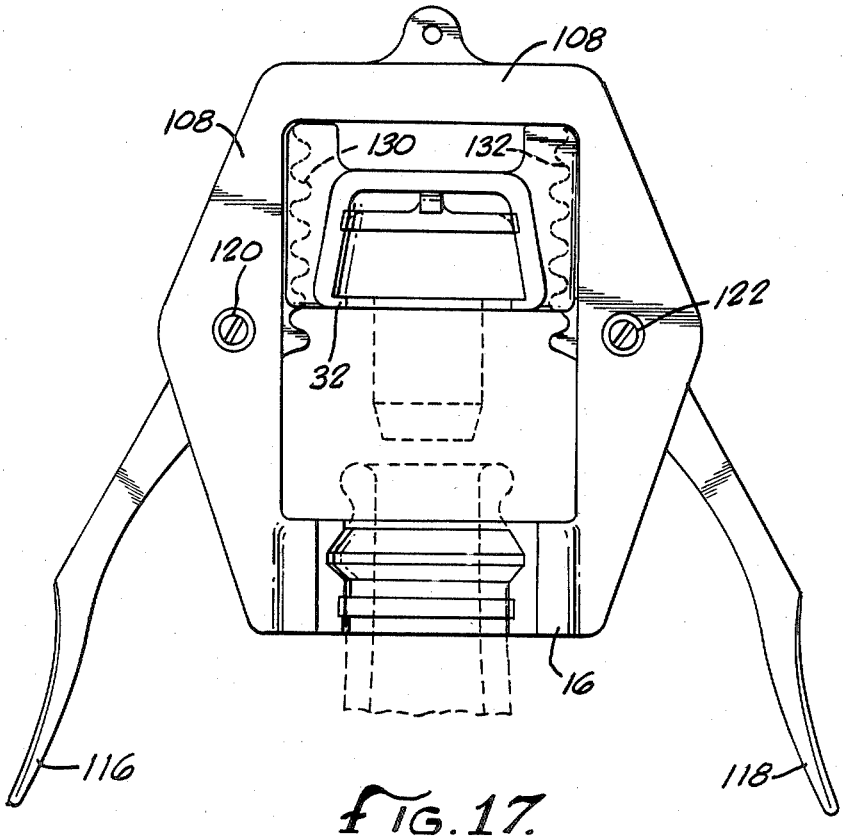
FIG. 17 is a side view of this third embodiment, showing the device in the open position, after it has removed the cork from the bottle.
Figure 18:
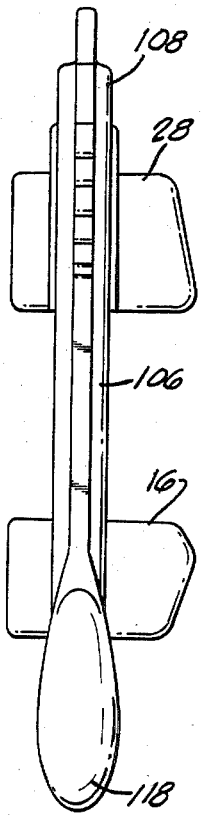
FIG. 18 is a side view of this third embodiment in the open position.

In this embodiment, the second member 12 has a similar cavity 30, but the body 128 has inset rack gears 130 and 132 formed on opposing sides thereof. In operation, as handles 116 and 118 are rotated downward (counter-clockwise for handle 116 and clockwise for handle 118 as shown in FIG. 15), the ratchet teeth 124 and 126 are rotated, engaging rack gears 130 and 132, causing second member 12 to separate from first member 10. The ratchet teeth 124 nad 126 in the rack gears 130 and 132 also act as the guide to maintain linear separation. Cross-piece 108 provides the stop against which second member 12 comes into contact. As seen in FIG. 17, the size of open space 110, which controls the distance that second member 12 can travel therein, is sufficiently large to allow the cork to be entirely removed from the bottle.

Although the invention hereinafter claimed has been shown and described above with particularity, it will be apparent to those skilled in the art that other modifications upon the embodiments shown and described may be made without departing fom the inventive concepts claimed herein. Accordingly, the scope and protection of this patent are not to be limited to the embodiments specifically shown and described above, but are of the full breath and scope of the appended claims.

What is claimed is:

1. A device for controlled removal and reinsertion of a cork having a head from a standard champagne bottle which has an exterior circumferential rib about its neck near the spout, the device comprising:

(a) a first member having a body and a channel in said body, said channel designed and constructed to fit the neck of the bottle, said first member also having a semicircumferential groove within said channel which engages the circumferential rib on the neck of the bottle;

(b) a second member, attached to said first said member, said second member having a body and a cavity therein designed and constructed for insertion onto the cork head, said second member further having an inwardly extending semi-circular flange on the bottom of said body and a top piece designed and constructed such that when in position on the cork, said second member engages at least a portion of the top and bottom of the head of the cork, such that said second member can be used to pull the cork out of the bottle, or to push the cork back into the bottle; and (c) linkage and handle means for attaching said first member to said second member and for causing said first member and second member to separate and return, linearly, and under leverage, a sufficient distance to pull the cork out of the bottle or to reinsert the cork back into the bottle, wherein said linkage and handle means comprises an elongate handle, one end thereof being journalled to opposing sides of said second member, and journalled at a second point to one end of a dog-leg linkage, which linkage is journalled at a second end to said first member, such that rotating said handle downward causes said first and second members to separate.

2. The device of claim 1 further comprising guide means attached to said first member and to said second member for guiding the linear separation and return of said first member and said second member.

3. The device of claim 2 wherein said guide means comprises a pin attached to said first member and extending perpendicularly thereabove and a channel formed in said second member, said pin housed and slidable within said channel.

4. The device of claim 3 further comprising means attached to said first member for gripping the bottle and means attached to said second member for gripping the cork, such that said device will remain in position on the bottle, and the cork, once removed from the bottle, will remain attached to said second member.

5. A device for controlled removal and reinsertion of a cork having a head from a standard champagne bottle which has an exterior circumferential rib about its neck near the spout, the device comprising:

(a) a first member having a body and a channel in said body, said channel designed and constructed to fit the neck of the bottle, said first member also having a semicircumferential groove within said channel which engages the circumferential rib on the neck of the bottle;

(b) a second member, attached to said first said member, said second member having a body and a cavity therein designed and constructed for insertion onto the cork head, said second member further having an inwardly extending semi-circular flange on the bottom of said body and a top piece designed and constructed such that when in position on the cork, said second member engages at least a portion of the top and bottom of the head of the cork, such that said second member can be used to pull the cork out of the bottle, or to push the cork back into the bottle; and (c) linkage and handle means for attaching said first member to said second member and for causing said first member and second member to separate and return, linearly, and under leverage, a sufficient distance to pull the cork out of the bottle or to reinsert the cork back into the bottle, wherein said handle and linkage means comprise a pair of elongate handles, each journalled at its proximal end to opposite sides of said second member, and each journalled at another point between said proximal end and the centerpoint of said handles to a linkage which is in turn journalled to opposite sides of said first member, all journal points lying in a plane which bisects the bottle in the device laterally such that coincident rotation downward of said handles causes said first member and said second member to separate linearly, and under leverage.

6. The device of claim 5 further comprising guide means for insuring linear separation of said first member and said second member.

7. The device of claim 6 wherein said guide means comprises a pin attached to said first member and extending perpendicularly thereabove, and a channel formed in said second member, said pin housed and slidable within said channel.

8. The device of claim 7 further comprising means attached to said first member for gripping the bottle and means attached to said second member for gripping the cork.

9. A device for controlled removal of a cork from a standard champagne bottle which has a circumferential rib on its neck near the spout, the device comprising:

(a) a first member having a U-shaped channel therein, said channel having an interior configuration which approximates the exterior configuration of the neck and spout area of the bottle such that it will slide laterally onto the neck of the champagne bottle, said channel further having a groove formed therein which, upon insertion of said first member onto the bottle, accommodates the circumferential rib on the neck of the bottle, and such that said first member, in this position, will not move longitudinally relative to the bottle;

(b) a second member attached to said first member, said second member having a cavity therein having a configuration which approximates the configuration of the head portion of the cork such that it will slide laterally onto the cork head when the cork is in the bottle, said second member further having a flange inwardly extending on the bottom side thereof which, when said second member is in position on the cork head will extend underneath the flared skirt portion of the cork head, such that said flange will engage said cork head to remove the cork from the bottle; and (c) handle and linkage means for causing said first member and said second member to separate and return linearly, and under leverage, a sufficient distance to cause the cork to be removed from or reinserted into the bottle, wherein said handle and linkage means comprises a pair of elongate handles, one journalled to each side of said first member at a journal pin, each said handle having, at its end thereof journalled to said first member, ratchet teeth formed in a semi-circular configuration with said journal pin of said handle to said first member being the center point of said semi-circular configuration, and a gear rack on opposing sides of said second member, which gear rack is engaged by said ratchet teeth on said handle, such that as said handles are rotated downward, said second member is moved away from said first member, and such that as said handles are rotated upward, said second member is moved toward said first member.

10. The device of claim 9 further comprising clip means attached to said first member and said second member for gripping said bottle and said cork, respectively.

11. A device for controlled removal of a cork from a standard champagne bottle which has a circumferential rib on its neck near the spout, the device comprising:

(a) a first member having a U-shaped channel therein, said channel having an interior configuration which approximates the exterior configuration of the neck and spout area of the bottle such that it will slide laterally onto the neck of the champagne bottle, said channel further having a groove formed therein which, upon insertion of said first member onto the bottle, accommodates the circumferential rib on the neck of the bottle, and such that said first member, in this position, will not move longitudinally relative to the bottle;

(b) a second member attached to said first member, said second member having a cavity therein having a configuration which approximates the configuration of the head portion of the cork such that it will slide laterally onto the cork head when the cork is in the bottle, said second member further having a flange inwardly extending on the bottom side thereof which, when said second member is in position on the cork head will extend underneath the flared skirt portion of the cork head, such that said flange will engage said cork head to remove the cork from the bottle; and (c) handle and linkage means for causing said first member and said second member to separate and return linearly, and under leverage, a sufficient distance to cause the cork to be removed from or reinserted into the bottle, wherein said handle and linkage means comprises an elongate handle, one end thereof comprising a pair of mirror image legs, each said leg having an upper lug and a lower lug formed in the distal ends of said legs, the upper lug being journalled to opposing sides of said second member, the lower lug journalled to one end of a dog leg linkage, which linkage is journalled at its second end to said first member, such that rotating said handle downward causes said first and second members to separate, linearly and under leverage.

12. A device for controlled removal of a cork from a standard champagne bottle which has a circumferential rib on its neck near the spout, the device comprising:

(a) a first member having a U-shaped channel therein, said channel having an interior configuration which approximates the exterior configuration of the neck and spout area of the bottle such that it will slide laterally onto the neck of the champagne bottle, said channel further having a groove formed therein which, upon insertion of said first member onto the bottle, accommodates the circumferential rib on the neck of the bottle, and such that said first member, in this position, will not move longitudinally relative to the bottle;

(b) a second member attached to said first member, said second member having a cavity therein having a configuration which approximates the configuration of the portion of the cork such that it will slide laterally onto the cork head when the cork is in the bottle, said second member further having a flange inwardly extending on the bottom side thereof which, when said second member is in position on the cork head will extend underneath the flared skirt portion of the cork head, such that said flange will engage said cork head to remove the cork from the bottle; and (c) handle and linkage means for causing said first member and said second member to separate and return linearly, and under leverage, a sufficient distance to cause the cork to be removed from or reinserted into the bottle, wherein said handle and linkage means comprise a pair of elongate handles, each journalled at its proximal end to opposite sides of said second member, and each journalled at another point between said proximal end and the centerpoint of said handle to a linkage which is in turn journalled to opposite sides of said first member, all journal points lying in a plane which bisects the device laterally such that coincident rotation downward of said handles causes said first member and said second member to separate, linearly and under leverage.

* * * * *